United States Patent [19]

Bryan et al.

[11] Patent Number: 4,703,802

[45] Date of Patent: Nov. 3, 1987

[54] CUTTING AND RECOVERY TOOL

[75] Inventors: Leonard B. Bryan; Geoffrey O. Rouse; Hector McDonald, all of Aberdeen, Scotland

[73] Assignee: Deepwater Oil Services Limited of Unit Ten, Aberdeen, Scotland

[21] Appl. No.: 3,129

[22] Filed: Jan. 14, 1987

Related U.S. Application Data

[63] Continuation of Ser. No. 785,251, Oct. 7, 1985, abandoned.

[30] Foreign Application Priority Data

Oct. 6, 1984 [GB] United Kingdom ..... 8425298
Apr. 23, 1985 [GB] United Kingdom ..... 8510332

[51] Int. Cl.[4] ..... E21B 31/16
[52] U.S. Cl. ..... 166/298; 166/55.7; 166/98; 166/361
[58] Field of Search ..... 166/298, 361, 55.7, 166/55.6, 98, 85, 67; 294/86.34

[56] References Cited

U.S. PATENT DOCUMENTS

| | | | |
|---|---|---|---|
| 1,867,289 | 7/1932 | Ventresca | 166/55.7 |
| 2,934,147 | 4/1960 | Baker | 166/298 |
| 3,223,164 | 12/1965 | Otteman | 166/361 |
| 3,301,324 | 1/1967 | Smith | 166/78 |
| 3,376,927 | 4/1968 | Brown | 166/361 |
| 3,983,936 | 10/1976 | Kennard et al. | 166/361 |
| 4,047,568 | 9/1977 | Aulenbacher | 166/55.8 |
| 4,550,781 | 11/1985 | Kagler, Jr. | 166/55.7 X |

FOREIGN PATENT DOCUMENTS

| | | | |
|---|---|---|---|
| 155129 | 9/1985 | European Pat. Off. | 294/86.34 |
| 989021 | 1/1983 | U.S.S.R. | 175/298 |

*Primary Examiner*—James A. Leppink
*Assistant Examiner*—Hoang C. Dang
*Attorney, Agent, or Firm*—Ratner & Prestia

[57] ABSTRACT

A cutting and recovery tool for a well-head, having a housing which is adapted to engage with a side wall of the well-head to lock them together, and a mandrel extending through the housing and rotatable relative to the housing and adapted to carry a radially-acting cutter which severs the well-head below the area of engagement of the housing. This allows the well-head to be severed and withdrawn in a single operation.

8 Claims, 5 Drawing Figures

21
18
25
26
44
40
42
45
41
43

CUTTING AND RECOVERY TOOL

This application is a continuation of application Ser. No. 785,251, filed Oct. 7, 1985, now abandoned.

FIELD OF THE INVENTION

This invention relates to a cutting and recovery tool.

DESCRIPTION OF THE PRIOR ART

In the offshore oil industry when a site is to be abandoned and the rig moved to a different location, the well-head and at least nine feet of the casing lying below the sea-bed must be removed.

Conventionally, a swivel with a cutter tool suspended from it is landed onto the well-head from the rig. The tool is rotated and cuts the casing at the desired depth. The swivel and cutter are then withdrawn to the rig and replaced with a 'spear'. The spear is landed onto the well-head where it engages with internal screw threads on the well-head. When the spear is lifted up to the rig it brings the well-head and the cut casing with it.

This operation downgrades the standard of the well-head for future use as the threads on the well-head are likely to be damaged.

Also, two 'trips' are required between the well-head and the rig, which is time-consuming and expensive.

SUMMARY OF THE INVENTION

According to the present invention there is provided a cutting and recovery tool comprising a housing provided with fixing means adapted to engage with a side wall of a well-head so that the housing and the well-head remain in engagement when the housing is subjected to an upward force, and a mandrel extending through the housing and being rotatable relative to the housing, the mandrel being adapted to carry a radially acting cutter.

The fixing means provided on the housing may be a screw thread or other configuration and may engage a preformed internal screw thread or groove formation on the well-head. The housing may be screwed or latched or stabbed into engagement with the well-head.

Preferably, the elongate member is a shaft and may be rotated by a motor on the well-head or rig.

Preferably, the elongate member is hollow to allow fluid to be pumped through the shaft to actuate the cutter.

The radially acting cutter may be a marine cutter for cutting the casing of an oil bore hole.

The fixing means provided on the housing may be adjustable or interchangeable to allow the housing to be secured to well-heads with a variety of thread diameters or groove formations.

BRIEF DESCRIPTION OF THE DRAWINGS

Embodiments of the present invention will now be described, by way of example, with reference to the accompanying drawings, in which.

DETAILED DESCRIPTION OF THE PREFERRED EMBODIMENTS

Figure 1:
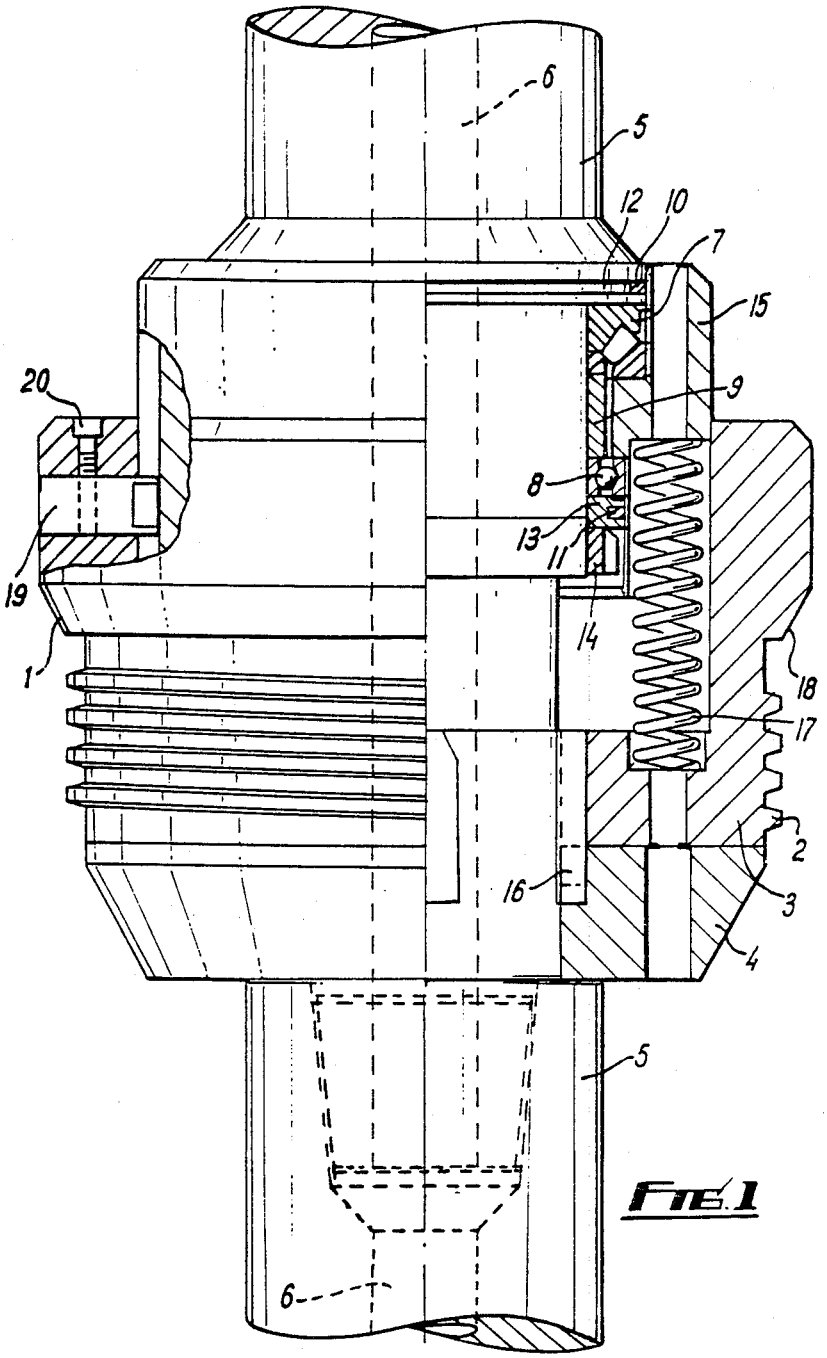
FIG. 1 is a part sectional side view of an anchoring swivel for a cutting and recovery tool of the invention.

Referring to FIG. 1, the tool of this embodiment of the invention has a housing 1 having a screw thread 2 on its outside surface. The screw thread 2 is formed on a grapple 3 and engages a screw thread on a well-head (not shown). Other embodiments of the invention may have outwardly spring-loaded segments having screw threaded outer surfaces which stab into engagement with the well-head internal thread. A tapered guide ring 4 helps to guide the housing 1 into the correct position in the well-head.

A mandrel in the form of a stepped shaft 5 passes through the housing 1. The shaft 5 has a through bore 6 to allow fluid to be pumped through to activate a casing cutter (not shown) carried on the lower end of the shaft 5.

The shaft 5 is supported in the housing 1 on thrust bearings 7 and radial bearings 8. The bearings 7, 8 are separated by a bearing spacer 9. Above and below the bearing are seals 10, 11. The seal 10 above the bearings 7, 8 lies in a groove 12 in the shaft 5 and the seal 11 below the bearings 7, 8 lies in a seal housing 13. The seal 11, its housing 13, the bearings 7, 8 and spacer 9 are kept in position by a locknut 14 and are contained in a swivel housing 15.

Splines 16 extend between the shaft 5 and the housing 1. The splines 16 are biassed into engagement by six springs 17 mounted on the grapple 3 and the swivel housing 15. When the housing 1 is to be screwed to the well-head sufficient weight is applied downwards on the shaft 5 to guide in and locate the grapple 3 in the well-head but not to compress the springs 17, therefore maintaining the splines 16 in engagement. By rotating the upper end of the shaft 5 to the left from a rotary table (not shown) the housing 1 is screwed to the well-head by virtue of the splines 16 extended between shaft 5 and housing 1. A tapered face 18 behind the threads 2 mates with a corresponding face on the well-head.

When the housing 1 is secure additional weight is applied downwards to shaft 5, compressing the springs 17 and pushing splines 16 out of engagement. Shaft 5 is now free to rotate.

Fluid is then pumped through the bore 6 in the shaft 5 and the shaft 5 rotated. The actuated cutter cuts through the casing (not shown) connected to the well-head. When the casing has been cut, the cutter is de-actuated and the shaft 5 'stopped'. By reducing weight while turning shaft 5 slowly, splines 16 are re-engaged.

Pulling upwards on shaft 5 will remove the well-head and cut section of casing by virtue of the screw thread engagement of the housing 1 on the well-head.

The grapple 3 and the swivel housing 15 are prevented from rotating relative to one another by keys 19 which are held in place by locking screws 20.

The screw thread 2 could be a standard small diameter and adaptors can be provided to increase the diameter for use on larger well-heads.

Figure 2:
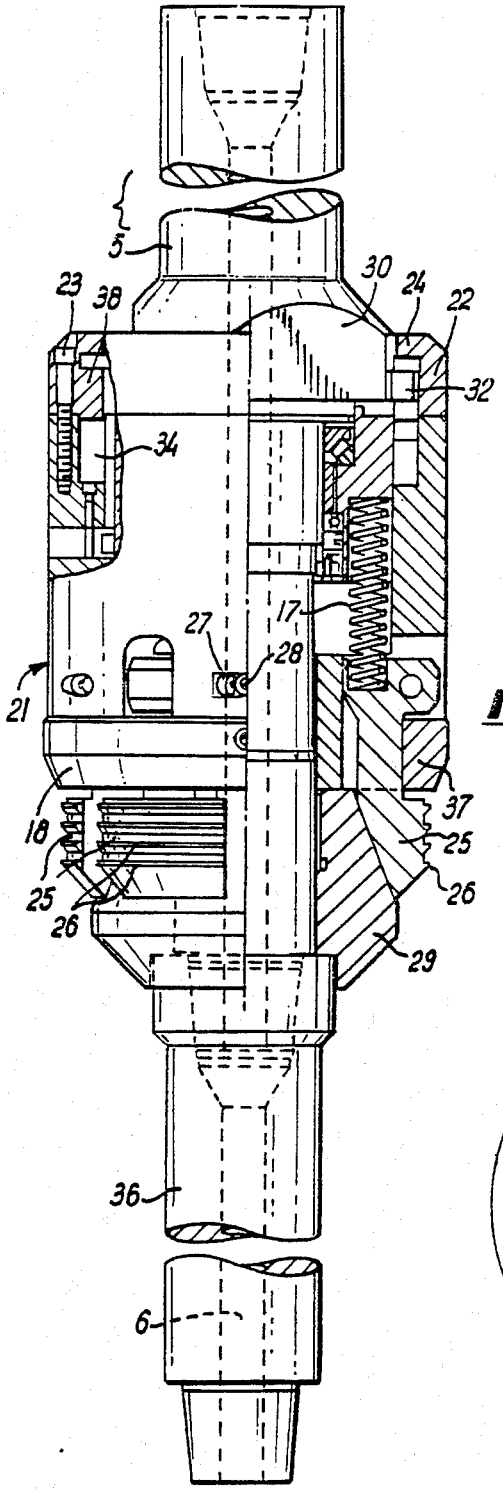
FIG. 2 is a view corresponding to FIG. 1 of an alternative form of a tool of the invention.
Figure 3:
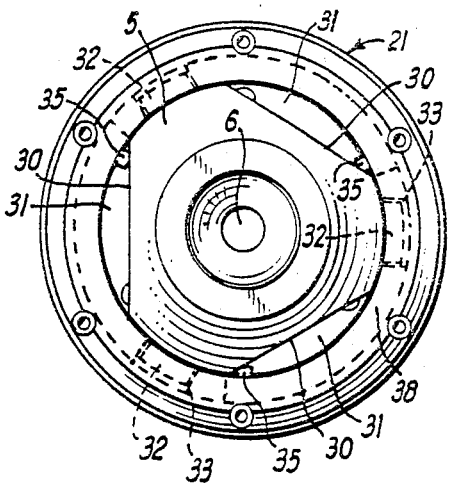
FIGS. 3 and 4 are respectively a rear view and a front view of the tool of FIG. 2.
Figure 4:
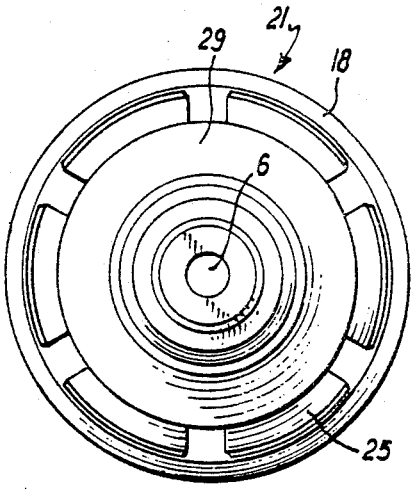

The tool shown in FIGS. 2, 3 and 4 is generally similar to that of FIG. 1 and corresponding parts to FIG. 1 will be identified by the same reference numerals in the drawings and following description. The tool of FIG. 2 has a cylindrical body 21 having a latch ring 22 secured to it at its upper end by bolts 23. The latch ring 22 has an annular flange 24 which allows the tool to be retrieved from a well-head in the event of its breakage in use.

Figure 5:
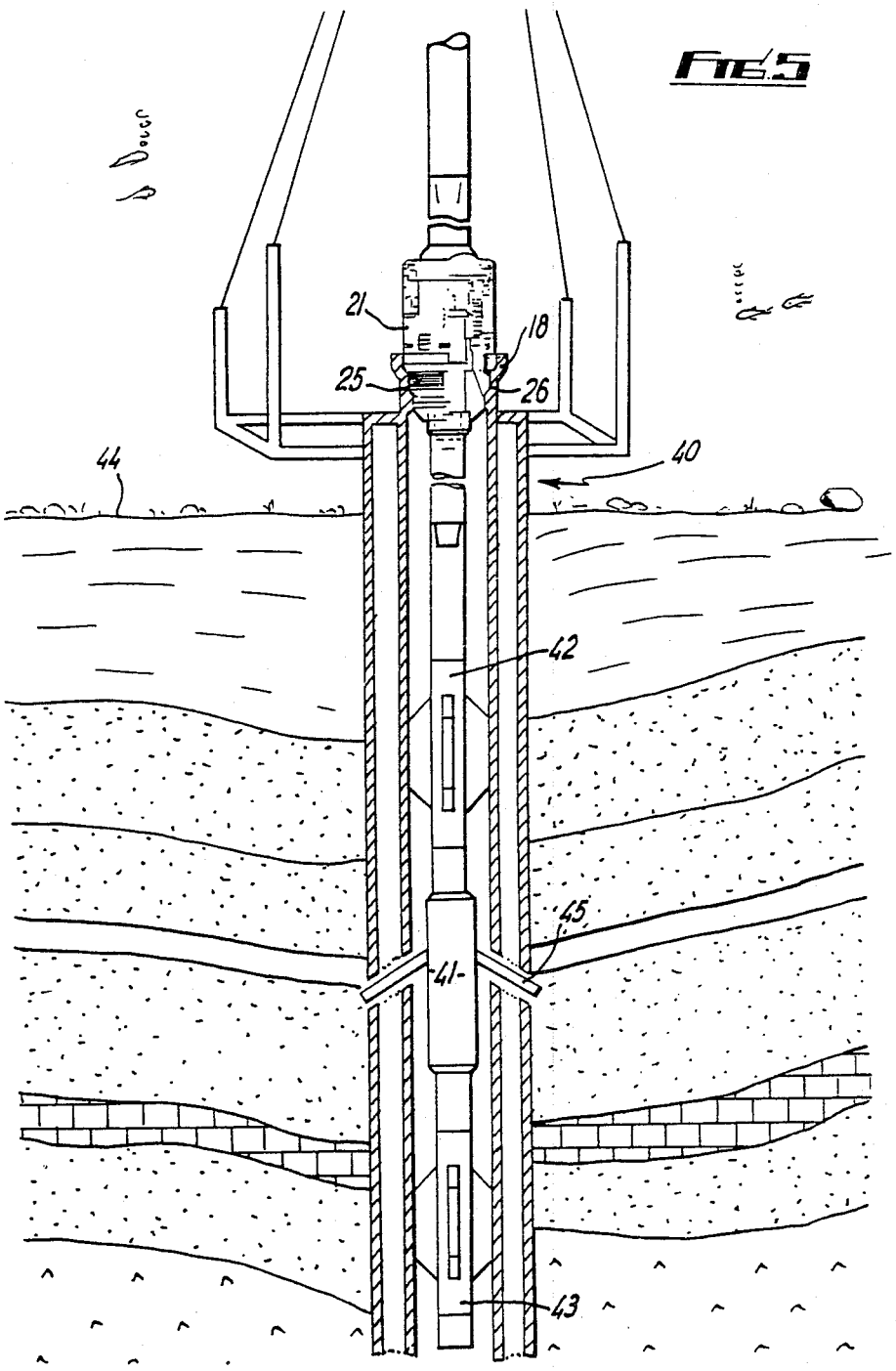
FIG. 5 is a part sectional view showing the tool of FIG. 2 in use.

The grapple 3 of the tool of FIG. 1 is replaced by six circumferentially-spaced arms in the form of grapple segments 25 each of which has inclined teeth 26 for engaging an internal screw thread on an inner face of a well-head 40 (FIG. 5). The screw thread on the well-head 40 is adjacent the well-head's upper end. The segments 25 are interchangeable with segments having different teeth arrangements so as to engage with particular well-head screw threads, the segments 25 being held in place on the body 21 by pins 27. The pins 27 are arranged so that the heads of each pair of adjacent pins are both locked in position by a retaining screw 28; to remove a pair of segments 25 the screw 28 is removed, allowing the corresponding pair of pins 27 to be withdrawn releasing the segments.

The segments 25 are pivotal about their pins 27 and have a tapered inner face which mates with a correspondingly-tapered outer face of a collar 29 which is axially movable relative to the grapple segments 25.

A stop ring 37 is mounted around the segments 25, the ring 37 having the downwardly-directed tapered face 18.

The shaft 5 has three flats 30 formed along its outer face within the body 21 thus providing passageways 31 between the flats 30 and the inner face of the body 21 for return flow of drilling fluid through the tool. Extending radially outwardly from the shaft 5 at its upper end within the body 21 are three equi-spaced lugs 32 which fit within cut-outs 33 in a plate 38 mounted below the latch ring 22. Below the plate 38 is an annular space 34 into which the lugs 32 can move on compression of the springs 17, taking the lugs out of engagement with the cut-outs 33. Three stops 35 project inwardly from the body into the annular space 34.

In use, the tool of FIGS. 2, 3 and 4 operates as follows. A rotary cutting tool 41 is secured through a stabiliser 42 to the lower end of a bottom sub 36 screwed to the tool so that the cutter is about 5 meters below the tapered face 18 of the stop ring 37. A further stabiliser 43 is screwed to the lower end of the cutting tool 41. The tool with the cutter 41 attached is then lowered into the well-head 40 to be removed from the sea bed 44 until the teeth 26 engage the screw-threaded grooves pre-formed in the well-head inner face. The teeth 26 are snapped into the grooves by application of a downward force on the shaft 5 which causes slight movement of the grapple segments 25 upwardly relative to the collar 29 against the action of the springs 17; this provides the segments 25 with the necessary flexibility to enter the grooves whereupon the springs 17 return them to a position where they are locked into the grooves by the tapered face of the collar 29.

The upwardly-inclined attitude of the teeth 26 as shown in FIG. 2 assists in their snap-in connection into the grooves in the well-head.

When the teeth 26 are in position in the grooves the tapered face 18 of the stop ring 37 engages the correspondingly-tapered face at the top of the well-head, ensuring a secure seating for the tool on the well-head. A downward force of around 4500 kg is applied at the surface to the tool through the shaft 5. The springs 17, which are each of 450 kg rating, are as a result compressed against the fixed mounting of the stop ring 37 on the well-head, causing the shaft 5 and collar 29 to move downwardly relative to the outer assembly formed by the body 21, latch ring 22, stop ring 37 and grapple segments 25. This moves the lugs 32 out of engagement with the cut-outs 33 of the plate 38 and into the annular space 34 below the stops 35, which frees the shaft 5 for rotation relative to the outer assembly. The shaft 5 is then rotated by means of a rotary table at the surface, and this drives the cutter 41 whose outwardly-pivoting cutting arms 45 sever the well-head 40 at a distance of 5 meters below the top of the well-head 40. At this stage the collar 29 is spaced downwardly from engagement with the segments 25, but the tool is held immovable by means of the 4500 kg force pushing the tapered face 18 of the stop ring 37 against the well-head.

When the cutting is complete rotation of the shaft 5 is stopped and the downward applied force is reduced from 4500 kg to 2200 kg, which allows the springs 17 to move the shaft 5 upwardly relative to the outer assembly until the lugs 32 abut the underside of the plate 38. The shaft 5 is then rotated anti-clockwise (referring to FIG. 3) until the lugs 32 engage the cut-outs 33 of the plate 38. The applied force to the tool is then released, and the lugs 32 enter the cut-outs. This further moves the grapple segments 25 and collar 29 axially together so that the segments are moved radially outwardly by the tapered face of the collar, forcing the teeth 26 firmly into locking engagement with the grooves of the well-head. An upward pulling force can then be applied to the shaft 5 and the tool, cutter 41, stabiliser 42, 43 and cut portion of well-head 40 are raised to the surface without damaging the integrity of the cut well-head.

Once at the surface a downward force is applied to the shaft 5, compressing the springs 17 and taking the lugs 32 out of the cut-outs 33 but not beyond the stops 35. The shaft 5 is then rotated clockwise (referring to FIG. 3) until the lugs 32 engage the stops 35. The applied force is then released, and the lugs 32 abut the underside of the plate 38 under the action of the springs 17. In this position the collar 29 is clear of the grapple segments 25 which then can move inwardly out of engagement with the well-head grooves, and the tool is then easily withdrawn from the well-head without damaging either itself or the well-head. Alternatively the tool can simply be rotated thereby unscrewing the segments 25 from the screw-threaded grooves of the well-head.

The invention is particularly suited for use on semi-submersible rigs where the cutting operation must be carried out from the well-head, not from the rig.

Modifications and improvements may be incorporated without departing from the scope of the invention.

We claim:

1. A method of severing and recovering a wellhead and casing, comprising engaging with an upwardly directed face of the well-head a tool comprising a housing which has means for coupling the tool to an existing formation on a sidewall of the wellhead, a mandrel which is spring biassed upwardly relative to the housing, the mandrel passing through the housing, locking means which prevents rotation of the mandrel relative to the housing when the mandrel is in its uppermost position and which releases the mandrel for rotation relative to the housing on downward movement of the mandrel, and a radially-expandable casing cutter on the mandrel, the cutter being spaced below the housing, coupling the housing to said existing formation on the wellhead so that the housing and the wellhead remain coupled on application of an upward force to the housing, applying a downward force to the mandrel to move the mandrel downwardly through the housing against the action of said spring bias, thereby to release said locking means, maintaining said downward force at a magnitude sufficient to hold said locking means in its released position and to hold said cutter at a constant distance below the housing, rotating the mandrel relative to the housing to cause the radially acting cutter to rotate, expanding the cutter radially to engage and sever a side wall of said casing, reducing the magnitude of said downward force to move the mandral upwardly relative to the housing, under the action of the spring bias, re-engaging the locking means to prevent rotation of the mandral realtive to the housing and applying an upward force to the mandrel thereby to raise the wellhead and severed casing.

2. A method according to claim 1, wherein the housing is coupled to the wellhead by engaging teeth on an outwardly-directed face of the housing with a complementary existing formation on an inwardly-directed face of the wellhead.

3. A method according to claim 2, wherein said teeth are radially movable on the housing and engage with a tapered face on the mandrel.

4. A method according to claim 2, wherein said existing formation on said inwardly-directed face of the wellhead comprises a screw thread pre-formed in said face.

5. A method according to claim 4, wherein after raising the wellhead and severed casing the mandrel and housing are rotated to unscrew the housing from the wellhead.

6. A method of severing and recovering a wellhead and casing, comprising the steps of engaging with an upwardly-directed face of the wellhead a tool comprising a housing which has means for coupling the tool to an existing formation on a side wall of the wellhead, a mandrel passing through the housing and movable therethrough, the mandrel being spring-biased upwardly relative to the housing, and a radially-expandable casing cutter on the mandrel, the cutter being spaced below the housing, coupling the housing to said existing formation on the wellhead so that the housing and the wellhead remain coupled on application of an upward force to the housing, applying a downward force to the mandrel to move the mandrel downwardly through the housing against the action of said spring bias, maintaining said downward force at a magnitude sufficient to hold said cutter at a constant distance below the housing, rotating the mandrel relative to the housing to cause the cutter to rotate, expanding the cutter radially to engage and sever a side wall of the casing, reducing the magnitude of said downward force to allow the mandrel to move upwardly relative to the housing under the action of said spring bias, and applying an upward force to the housing thereby to raise the wellhead and severed casing.

7. A method according to claim 6, wherein the housing is coupled to said existing formation on the wellhead by latching-in radially-expandable teeth on the outer face of the housing with a pre-formed series of grooves on an inner face of the wellhead.

8. A method according to claim 7, wherein said grooves on the inner face of the wellhead form a screw thread.

* * * * *